United States Patent [19]

Hill et al.

[11] 4,004,337

[45] Jan. 25, 1977

[54] APPARATUS FOR REED SWITCH MANUFACTURE

[75] Inventors: John Hill, Bickley; Henry Turczanki, Beckenham, both of England

[73] Assignee: Comtelco (U.K.) Limited, Tonbridge, England

[22] Filed: Apr. 29, 1975

[21] Appl. No.: 572,910

Related U.S. Application Data

[62] Division of Ser. No. 443,203, Feb. 19, 1974, Pat. No. 3,908,266.

[30] Foreign Application Priority Data

Feb. 20, 1973 United Kingdom ..... 8276/73

[52] U.S. Cl. ..... 29/756; 29/622

[51] Int. Cl.[2] ..... H01H 11/00

[58] Field of Search ..... 29/622, 203 P, 203 J; 200/144 R, 165; 65/DIG. 12, 138, 139, 155, 32, 40, 42

[56] References Cited

UNITED STATES PATENTS

| | | | |
|---|---|---|---|
| 3,432,282 | 3/1969 | Schulz | 65/40 X |
| 3,537,276 | 11/1970 | Pityo | 29/622 X |
| 3,550,268 | 12/1970 | Santi | 29/622 |
| 3,628,242 | 12/1971 | Zollman | 29/622 |

*Primary Examiner*—James R. Duzan

*Attorney, Agent, or Firm*—Weingarten, Maxham & Schurgin

[57] ABSTRACT

The invention relates to a method and apparatus for the encapsulation of a switch contact sub-assembly, in which sub-assembly at least two contacts are rigidly joined in a desired spatial relationship by a destructible bridging piece, wherein the sub-assembly is inserted into a glass tube continuously purged with inert gas and the tube sealed to the sub-assembly by heating two spaced apart regions thereof followed by removal of surplus tube and, in a further aspect of the invention, destruction of the bridging piece.

11 Claims, 13 Drawing Figures

APPARATUS FOR REED SWITCH MANUFACTURE

This is a division, of application Ser. No. 443,203, filed Feb. 19, 1974, now U.S. Pat. No. 3,908,266.

The present invention relates in general to a method and apparatus for encapsulating the component parts of an electrical device, and more particularly concerns a method for the encapsulation of electrical elements in electrical devices such as reed switches, mercury wetted sealed contacts, neon lamps, and multiple contact encapsulated switches.

While the present invention is applicable to a wide variety of electrical devices in which contacts must be oriented precisely with respect to each other within an enclosure for requisite accuracy, stability and long life, the principles and objects of this invention will be fully explained with specific reference to the efficient, low cost manufacture of high quality reed switches hermetically sealed in glass or comparable materials.

The course of development of reed switches is described in detail in an article entitled "Development of Reed Switches and Relays" by O. M. Hovgaard and G. E. Perreault, *Bell System Technical Journal*, Vol. 34, No. 2, March 1955, pp. 309–332. Typical prior methods for assembling reed switches are described in E. L. Pityo, U.S. Pat. No. 3,537,276, entitled Method of and Apparatus for Producing Magnetic Reed Switches, dated Nov. 3, 1970, and in P. M. Zollman, U.S. Pat. No. 3,628,242, entitled Manufacture of Electrical Switches, dated Dec. 21, 1971.

More specifically the Pityo patent discloses a fabrication technique in which a pair of reed blades are each held by a respective jaw mechanism within a glass sleeve disposed around the blades. The reed blades are caused to engage, or are latched to one another by an applied magnetic field, one jaw is released and the confronting unsecured end of the glass sleeve sealed to the associated lead portion of the reed blade. Thereafter the magnetic latching force is removed, the unsealed reed blade is displaced by a predetermined amount to define the desired gap between the contacts, and this reed blade is then sealed to the associated end of the glass envelope to complete the assembly. The technique proposed by Zollman is similar and employs a pair of reed blades magnetically held in overlapping relationship by a jaw affixed to one of the reed blades. A glass sleeve is installed over the magnetically held reed blades and the end of the glass adjacent the unsecured reed blade is sealed to this reed blade. The magnetic force is then removed and the second reed blade displaced laterally from the first by a predetermined amount to establish the contact gap. The displaced reed blade is then sealed to the glass sleeve to complete the device.

The teachings of both Pityo and Zollman necessarily require the fabrication and utilization of assembly machines which are inherently complex, both mechanically and electrically, and require highly skilled labour to maintain production efficiency and economy. Both combine the functions of accurately positioning the switch contact reed blades and sealing them into the glass envelope. Resultantly, inaccuracies are introduced due to expansion as positioning mechanisms become heated in the course of sealing the glass envelopes.

German Pat. No. 1,184,015 published Dec. 23, 1964 discloses a manufacturing technique whereby the reed blades initially constitute integral central portions of a generally open rectangular metal frame. The entire frame is first placed in a press which crimps the structure and brings the contact portions into predetermined alignment to define the contact gap. A glass enclosure is slipped over and sealed to the aforesaid reed blade portions while still integral with the frame and in a final step, the exterior portions of the frame are cut away, leaving a completed reed switch. During the sealing step the inner confronting ends of the blades are free; therefore, as set forth above with reference to the prior Pityo and Zollman patents, distortion of the blades due to expansion and contraction during the sealing operation limits the accuracy to which reed switches may be made using this technique.

Other patents which disclose pertinent prior techniques and structure and are thus useful in providing a fuller understanding of this art are: U.S. Pat. Nos. 2,696,543; 2,978,556; 3,284,876; 3,345,593; 3,369,291; 3,432,282; 3,550,268; 3,568,310; and German Pat. No. 1,904,099; and a useful reference work which provides a comprehensive discussion of reed switches and their operating characteristics is "Designer's Handbook and Glossary of Terms" relative to reed relays available from Magnecraft Corporation, Chicago, Ill.

Encapsulation of the reed blades proposed by Pityo, Zollman and others, is performed using at least two techniques, both of which present a number of difficulties as will become apparent and which the invention seeks to solve.

Firstly, an infra-red technique is used to heat and fuse the glass envelope onto the reed blades, the radiation from a quartz iodine lamp being focussed by means of a parabolic reflector onto the appropriate regions of the glass. This technique requires the use of a special ferrous oxide glass which has a high infra-red absorption factor and is also expensive. Although high speed sealing is achieved, the glass tends to be spattered and deposited both inside and outside the encapsulation, the reflector reducing in efficiency over a period of time as a coating is deposited thereon as a white powder. Also, the lamps require changing frequently and then have to be re-focussed. The cost of the infra-red radiators is high, and the reflectors at least require cooling.

The second technique is to position a strip resistance heater around the regions to be sealed, the heater being powered by the output of a transformer, variac controlled.

Both these techniques tend to produce non-symmetrical seals that are not uniform from one sealing work station to another, and which seals can or may contain high stresses.

In both techniques the top seal is made first followed by re-positioning of the bottom blade and formation of the bottom seal. Whilst sealing is taking place, a jet of inert or reducing gas is directed into the glass envelope (which is usually a piece of glass tube cut to the desired capsule length) from a hypodermic needle situated outside the envelope. Such an arrangement causes air to be entrained in the gas stream and to be carried into the envelope. Furthermore, it is difficult to totally purge the interior of the envelope from contaminants, such as water vapour which is only released from the glass in the regions where sealing takes place, and remains adsorbed on the internal surfaces of the glass where heating has not occurred. Methods have been proposed for removing such contamination by the use of vacuum chambers in which encapsulation takes place, but again great capital and operating expense are involved with greater prospects of unreliability in the encapsulation plant.

Our co-pending application Ser. No. 423,735 discloses a method of rapidly joining together the electrical contacts of a reed switch, for example, in the desired spatial relationship by means of a fusible bridging piece welded or otherwise joined to the contacts. The sub-assembly thus formed may be handled for and during encapsulation without the requirement for complicated and expensive jigs.

Such a sub-assembly may be simply supported in a vertically aligned well, a glass tube placed thereover and two seals made without the need for other jigs. It has been found that flame sealing may then be readily used to form such seals by, for example, directing one or more flames onto a region of the glass tube where sealing is required whilst causing the assembly to rotate. It has also been found that, by making the glass tube longer than the desired length of finished capsule, a hypodermic needle from which issues a protective purge gas, may be inserted into the end of the tube to a depth determined by the selected position for the final seal. Air cannot be entrained with such an arrangement, and thorough purging takes place. Furthermore, by heating the whole of the glass tube in the sealing operation, to a temperature which may exceed 450° C or so, all adsorbed water vapour is driven off from the glass surfaces and flushed away by the purge gas. Such heating, again, may conveniently be carried out by flame heating.

Rotation of the assembly during such heating operations ensured even melting of the glass at the seals, and relatively stress free capsules.

A method is therefore provided by the invention of encapsulating a switch contact sub-assembly in which at least two contacts are rigidly but temporarily joined in a desired spatial relationship by at least one fusible and electrically conductive bridging piece which may be destroyed (after encapsulation) by melting, comprising the following steps:

1. Inserting the contact sub-assembly into a length of glass tube, the length of tube being greater than the desired length of capsule, an end of the contact sub-assembly protruding from a first end of the tube.

2. Holding the assembly of contact sub-assembly and tube in co-axial relationship for sealing.

3. Inserting the open end of a hypodermic needle into a second end of the tube, the need being connected to a supply of inert or reducing purge gas.

4. Sealing the first end of the tube to the protruding end of the contact sub-assembly by directing one or more flames towards the first end simultaneously injecting purge gas into the tube.

5. Maintaining the injection of gas, the whole length of tube is then heated to a temperature sufficient to release substantially all water vapour adsorbed on the surfaces of the tube.

6. Maintaining the injection purge gas, a region of the tube is then heated by one or more flames directed theretowards thereby effecting a further seal between tube and contact sub-assembly, which region is situated between the two ends of the tube at a distance from the first end corresponding to the desired length of capsule.

7. The hypodermic needle is removed and the assembly allowed to cool.

8. The skirt comprising the length of tube between the further seal and the second end is removed.

The method may include any or all of the following additional steps:

9. The assembly may be rotated during the heating operations.

10. The assembly may be preheated prior to any or all sealing operations, such preheating involving the direction of one or more flames towards those regions which are to be sealed.

11. A sealed region may continue to be heated for a predetermined length of time by one or more flames after completion of a sealing operation so that the cooling rate of the region is reduced.

12. Any sharp edge remaining as a result of removing the skirt may be removed by flame polishing.

13. The assembly may be vertically aligned during any or all of the above steps.

A reed switch thus encapsulated may then be completed by passing a pulse of electrical energy through the fusible bridging piece which is thereby disintegrated.

Apparatus contemplated by the invention may in one aspect comprise: at least one workhead, which may be rotatable, adapted to receive and support an assembly, which assembly comprises a contact sub-assembly in which at least two contacts are rigidly but temporarily joined in a desired spatial relationship by at least one fusible and electrically conductive bridging piece, and a length of glass tubing, all in co-axial vertical alignment, means for moving said workhead through a series of fixed work-stations, pausing at each whilst a manufacturing operation is performed on an assembly supported thereby, the one or more work-stations comprising: a station having means whereby an assembly is introduced to a workhead; at least one station having one or more burners the flames from which are adjusted and directed towards the position an assembly will occupy when pausing at the station; a station provided with means for retrieving a sealed assembly from a workhead; means at one or more-stations for injecting purge gas into an assembly comprising a hypodermic needle having an open end and adapted to be moved in a vertical plane, connected at the other end to a supply of pressurized purge gas, the needle being so positioned that a vertically downward movement will cause the open end to enter an assembly paused at the associated station. The apparatus may include means for rotating a workhead at one or more work-stations.

The apparatus may also comprise a work-station whereat surplus glass tube is removed from an assembly at completion of all sealing operations thereon, by cutting means such as sharp-edged wheels for example.

Although both the method and apparatus contemplated by the invention specifies the use of flame for heating operations upon an assembly, other forms of heating are not precluded from use in the invention.

An apparatus and a method of encapsulating reed switches will now be exemplified with reference to the accompanying drawings which are as follows.

Figure 1:
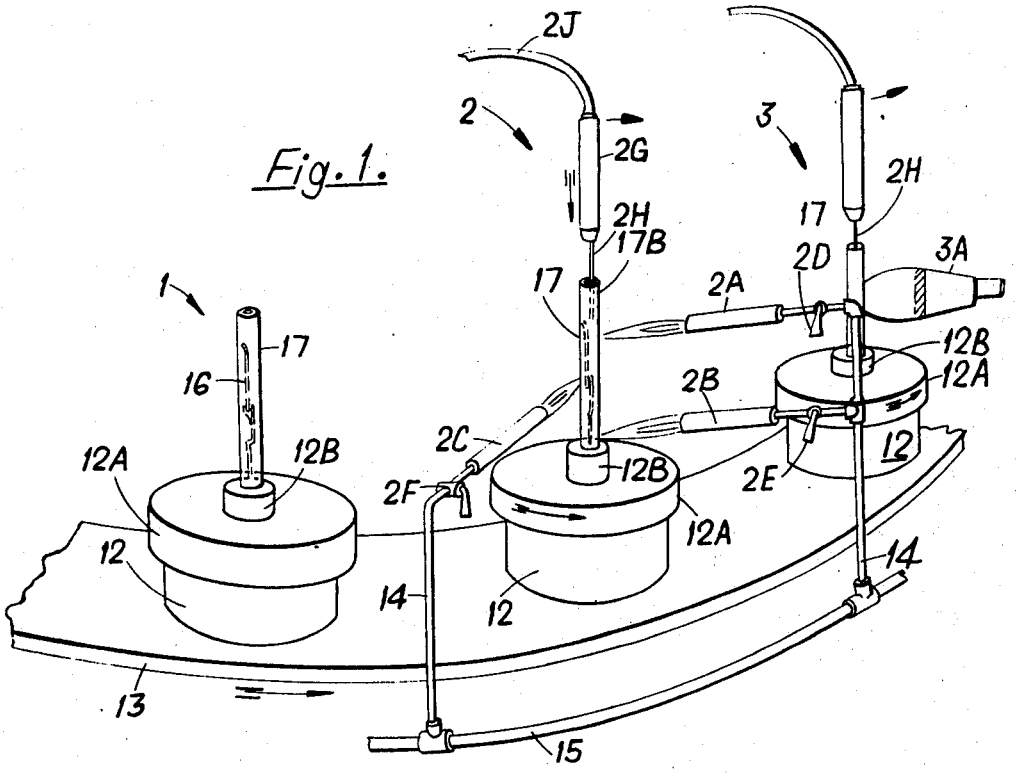
FIG. 1 is an illustration of part of an apparatus wherein reed switches are automatically encapsulated.

FIGS. 3 to 13 inclusive show the consecutive steps in the encapsulation of a switch contact sub-assembly as may be performed by the apparatus partly illustrated in FIG. 1.

Referring to FIG. 1, a series of workheads 12, of which only three are shown for clarity, are provided, each being mounted upon a rotatable circular table 13 around which are situated eleven fixed work-stations numbered from 1 to 11, again only three are illustrated. Each workhead has a rotatable platform 12A upon each of which platforms is an anvil 12B vertically and centrally bored to receive one end of a switch contact sub-assembly such as 16 (see also FIG. 2). The table 13 periodically moves each workhead from one work-station to the next whereat the head pauses for sufficient time for an operation to be performed.

Figure 2:
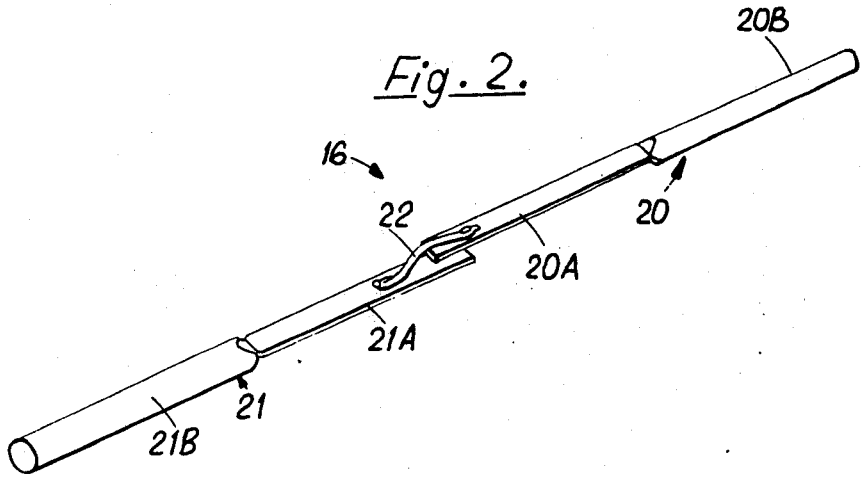
FIG. 2 is of a switch contact sub-assembly.

Referring now to FIG. 2, a contact sub-assembly 16 for a reed switch comprises contacts 20 and 21, each having a cylindrical portion 20B, 21B respectively and a contact blade 20A, 21A respectively which blades have been set in the desired spatial relationship for a finished reed switch and rigidly joined together by a bridging piece of wire 22 welded to each blade.

Figure 3:
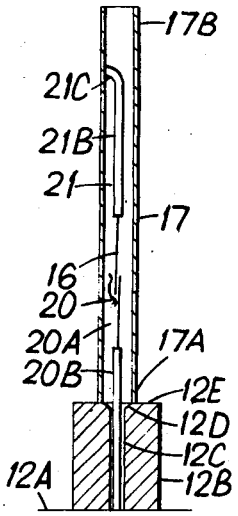
Figure 4:
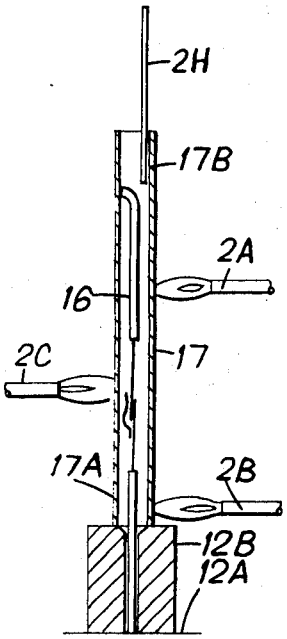
Figure 5:
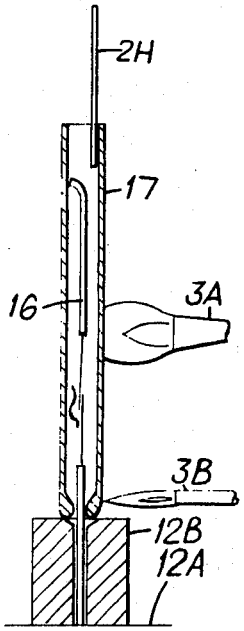
Figure 6:
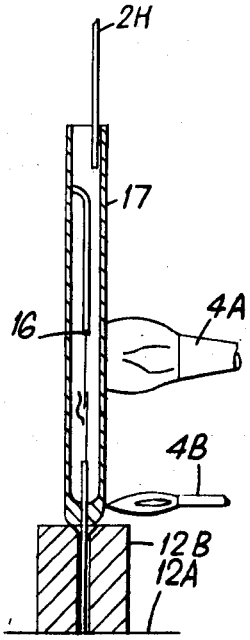
Figure 7:
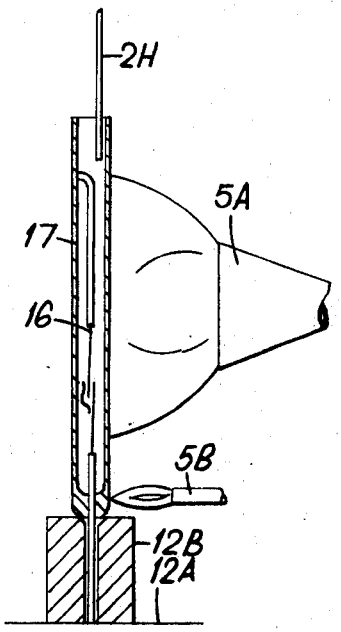
Figure 8:
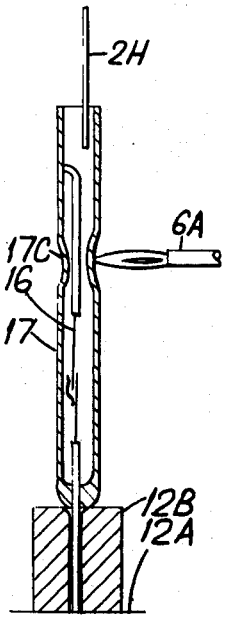
Figure 9:
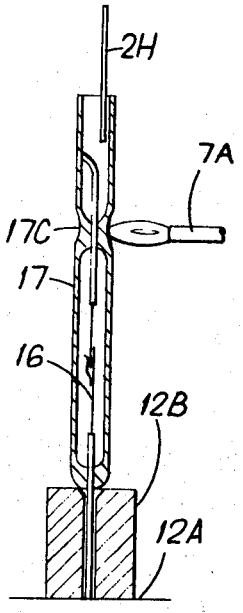
Figure 10:
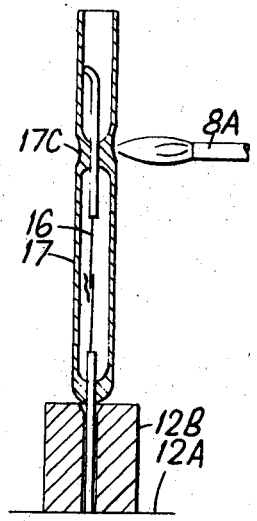
Figure 11:
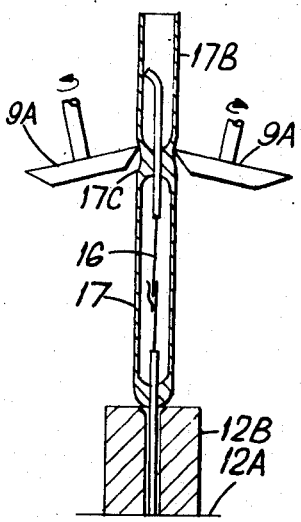
Figure 12:
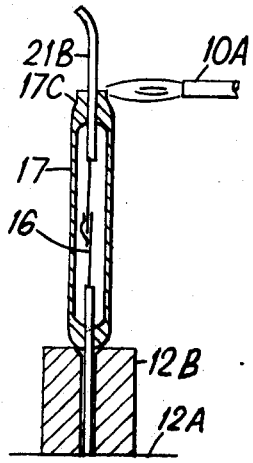
Figure 13:
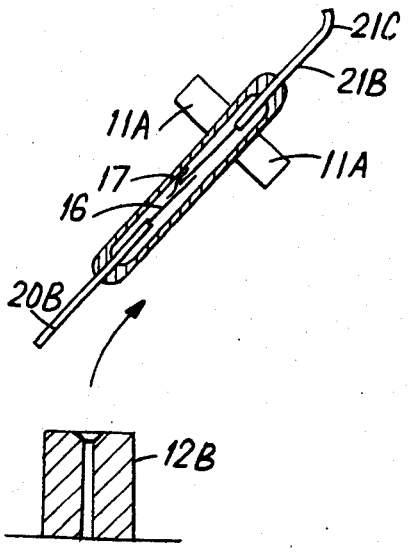

We will now follow a contact sub-assembly such as 16 through all the steps of encapsulation, starting with work-station 1 which corresponds with he manufacturing step illustrated in FIG. 3, moving on to station 2 corresponding to FIG. 4, then station 3, corresponding with FIG. 5. Work-stations 4 to 11, not shown in FIG. 1, are then visited in the order shown in corresponding FIGS. 6 – 13 inclusive.

Let us consider the workhead 12, shown at station 1. A transfer device notionally illustrated as 1A has just placed a contact sub-assembly 16 and encircling glass tube 17 on to anvil 12B of the workhead.

One end 20B of the sub-assembly 16 enters the hole in the anvil (such as hole 12C of FIG. 3) wherein it is supported in a substantially vertical position, glass tube 17 surrounding the sub-assembly being supported by the tip surface 12E of the anvil 12B. A chamfer 12C guides the end 20B into hole 12C.

The tip 21C of contact 21 may be slightly bent so that it touches the inner wall of glass tube 17, as shown in for example FIG. 3, so that sub-assembly 16 is maintained in vertical alignment.

Table 13 now rotates to bring the workhead into position at work-station 2 so that the flames of three gas burners 2A, 2B and 2C play onto the glass tube 17 (all the other workheads also moving forward to their next respective station). As the workhead comes to rest, a drive (not shown) engages with platform 12A which then rotates. At the same time, a probe comprising a hollow body 2G, a hypodermic needle 2H and a hose 2J which leads to a supply of nitrogen gas, is lowered so that the free end of the needle is inserted into the open end of the glass tube 17. Nitrogen, continuously issuing from the needle 2H, flushes and purges the tube 17 of both air and contaminants which may be released from the glass tube internal surfaces during the heating operation. The purpose of work-station 2 is to generally pre-heat the glass tube prior to sealing operations and, since all the workheads pause for the same length of time at such work-station, usually of the order of 2 to 3 seconds, the intensity of the flames of burners 2A, 2B or 2C, and indeed all the burners at work-stations, must be pre-set so that the glass reaches the required temperatures within this short period.

The burners of all the work-stations connect with a manifold 15 which is supplied with propane or other such flammable gas via for example pipes 14 and adjustable valves such as 2D, 2E and 2F, and all burn continuously, it being economic so to do since the transfer time of the workheads from one station to another is but a fraction of a second.

At the end of the pre-heat period at station 2, needle 2H remains in position and moves with the workhead to station 3 (see FIG. 5). The platform 12A rotates, whilst the flame of burner 3B partially melts the lower end 17A of tube 17 and that of burner 3A continues the general heating of the tube. The workhead and purge needle moves onto station 4 (FIG. 6), platform 12A rotates and the lower seal is completed by burner 4B, burner 4A continuing to heat tube 17 generally. In like manner, the platform rotates at each of work-stations 4 to 10 inclusive, purge gas needle 2H retracting from the open end 17B of tube 17 at station 7 or thereafter.

At station 4, burner 4B completes the lower seal whilst general heating of the tube 17 is continued by burner 4A.

Intense heating of tube 17 takes place at station 5 where burner 5A raises the temperature of the glass to over 450° C; thereby driving off any remaining surface contaminants. Burner 5B maintains the lower seal also at around 450° C so that uneven temperature distribution along tube 17 is avoided.

Moving on to station 6, burner 6A partially melts the tube at region 17C as the first step in making the upper seal.

Station 7 sees the completion of the seal at 17C by means of burner 7A.

In order to control the cooling of upper seal 17C, a further burner 8A is incorporated in station 8.

Top half 17B of tube 17 is removed at station 9 by means of hardened cutting wheels 9A which move into contact with the tube immediately above the region of upper seal 17C. Means, not shown but which could for example comprise a suction device, remove tube end 17B now separated from the remainder of the tube.

At station 10, any sharp edges left as a result of the cutting operation, are removed by a further burner 10A.

The now completely encapsulated switch contact sub-assembly 16 is removed from the workhead at station 11 by a transfer device, notionally illustrated as a pair of jaws 11A, which transfers the capsule to another piece of apparatus (not part of this invention) where bridging piece 22 is destroyed by means of a pulse of electrical energy and wherein the slight kink 21C in contact 21B is straightened, thus completing the reed switch.

The empty workhead now moves back to station 1 where the cycle of events re-commences. There being at least the same number of workheads as there are work-stations, an encapsulated sub-assembly will be produced every 2 – 3 seconds, the apparatus operating continuously to produce around 1500 capsules per hour at very low operating cost and for minimum outlay of capital.

A number of intermediate work-stations may be provided in order to regulate cooling of an assembly after a sealing operation.

Although an output of 1500 capsules per hour is given by way of example, the apparatus described herein is capable of higher rates of production.

In another form of the apparatus just described with reference to the accompanying drawings, work-stations 9 and 10 are omitted, being part of a separate apparatus which is also embraced by the invention, and to which the capsules are transferred when sealing is completed.

Although reed switch manufacture has been exemplified, other encapsulated electrical devices may be manufactured by the methods and apparatus of the invention. For example, high voltage switches which operate in high vacuo within a glass envelope may be encapsulated in a similar manner to that of the reed switch, but with the difference that open end 17B of tube 17 is connected to a vacuum pumping system, such as a rotary pump, diffusion pump and cold trap in series, and continuously pumped until after the final seal has been made. A further difference may be that the contacts to be sealed, may either or each have a glass bead fused thereonto at a further work-station included immediately after station No. 1. The glass bead serving to achieve a reliable high vacuum seal between the contact and the glass. If required the glass beads may be of different glass from that of the tube in order to obtain a better thermal expansion match between contact and tube.

We claim:

1. Electrical sub-assembly encapsulating apparatus comprising:

at least one workhead for supporting said sub-assembly at only one end thereof in vertical co-axial alignment with a length of glass tubing, the sub-assembly being composed of at least two conductive elements rigidly but temporarily joined in a desired spatial relationship by at least one fusible and electrically conductive bridging piece, said glass tubing being of a length greater than the desired length of the capsule being formed, said glass tubing and sub-assembly having an unsupported end;

means for moving said workhead through a series of fixed work stations, pausing at each while a manufacturing operation is performed on the supported sub-assembly and glass tubing;

one or more stations having one or more burners, the flames from which are adjusted and directed toward the position said sub-assembly and tubing will occupy when pausing at that station to provide sealing of said sub-assembly and said tubing to thereby encapsulate said conductive elements within said tubing; and means at one or more of said work stations for injecting purge gas into said tubing and including a hypodermic needle connected to a supply of pressurized purge gas and having an open end adapted to be moved into the unsupported open end of said tubing for introducing a flow of purge gas to the interior of said tubing during the sealing thereof.

2. Apparatus according to claim 1 in which the workhead is rotatable and including means for rotating the workhead when paused at a work-station.

3. Apparatus according to claim 1 in which a work-station is provided having means thereat for removing surplus glass tube from an assembly.

4. Apparatus according to claim 1 including a work-station provided with electrical contacts for connection to the contact sub-assembly after encapsulation is complete and having means for delivering a pulse of electrical energy to said sub-assembly so as to destroy the bridging piece.

5. The apparatus according to claim 1 wherein said means for injecting purge gas includes a hypodermic needle having an open end and adapted to be moved in a vertical plane, connected at the other end to a supply of pressurized purge gas, the needle being so positioned that a vertically downward movement will cause the open end to enter the tubing paused at the associated station.

6. The apparatus according to claim 1 wherein said one or more burners include means for directing said flames along the entire length of said tubing.

7. The apparatus according to claim 1 further including means at a second station for continuing the heating of said assembly for a predetermined length of time to minimize thermal stress of said assembly.

8. The apparatus according to claim 1 wherein said means for injecting purge gas is operative to inject gas continually throughout the sealing of said tubing with the confronting ends of said sub-assembly.

9. An apparatus according to claim 1 wherein one or more work-stations includes means for retrieving the encapsulated assembly from said workhead.

10. The apparatus according to claim 1 wherein one or more stations include:

one or more burners to provide pre-heating of said glass tubing;

one or more burners to provide sealing of the supported end of said glass tubing; and one or more burners to provide sealing of said unsupported end of said glass tubing.

11. The apparatus according to claim 10 wherein one or more burners provides heating along the entire length of said tubing during sealing of said sub-assembly and said tubing.

* * * * *

UNITED STATES PATENT AND TRADEMARK OFFICE

CERTIFICATE OF CORRECTION

PATENT NO. : 4,004,337

DATED : January 25, 1977

INVENTOR(S) : John Hill and Henry Turczanski

It is certified that error appears in the above-identified patent and that said Letters Patent are hereby corrected as shown below:

Column 3, line 51, "need" should be --needle--.
Column 4, line 41, "more-stations" should be --more work-stations--;
Column 4, line 59, "of" should be --for--.
Column 5, line 22, "he" should be --the--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*